US012600507B2

(12) United States Patent
Jaderlund

(10) Patent No.: US 12,600,507 B2
(45) Date of Patent: Apr. 14, 2026

(54) BOTTLE CONTENTS MERGING APPARATUS AND METHOD THEREOF

(71) Applicant: Pamela Jaderlund, Santa Fe, NM (US)

(72) Inventor: Pamela Jaderlund, Santa Fe, NM (US)

( * ) Notice: Subject to any disclaimer, the term of this patent is extended or adjusted under 35 U.S.C. 154(b) by 0 days.

(21) Appl. No.: 18/792,324

(22) Filed: Aug. 1, 2024

(65) Prior Publication Data

US 2025/0042582 A1 Feb. 6, 2025

Related U.S. Application Data

(60) Provisional application No. 63/516,867, filed on Aug. 1, 2023.

(51) Int. Cl.
*B65B 3/06* (2006.01)

(52) U.S. Cl.
CPC ..... *B65B 3/06* (2013.01)

(58) Field of Classification Search
CPC ..... B65B 3/06
USPC ..... 141/319, 320, 363–366
See application file for complete search history.

(56) References Cited

U.S. PATENT DOCUMENTS 983,348 A * 2/1911 Carpenter ..... B65D 47/286 222/207
1,052,391 A * 2/1913 Valerius ..... B01D 35/26 141/297
2,165,604 A * 7/1939 Abel ..... B43L 25/04 222/207
4,105,142 A * 8/1978 Morris, Jr. ..... G01F 19/00 141/319
4,201,252 A 5/1980 Noel
4,347,879 A * 9/1982 Blaser ..... B65D 71/502 D7/619.1
4,454,897 A 6/1984 Valiant
5,297,600 A 3/1994 Downes
6,745,802 B2 6/2004 Varga
9,199,832 B2 12/2015 Fracasso
2007/0277902 A1 12/2007 Dieudonat et al.
2011/0240153 A1* 10/2011 Podesta ..... F04B 33/00 137/565.25
2012/0298659 A1 11/2012 Bogner
2014/0291277 A1 10/2014 Perez

* cited by examiner

*Primary Examiner* — Jason K Niesz
(74) *Attorney, Agent, or Firm* — Gutwein Law; Tyler B. Droste

(57) ABSTRACT

An apparatus configured to enable the efficient transfer of the contents of a first bottle to a second bottle. The apparatus can be fluid merging apparatus that can include a first end and a second end. The first end can include a first container coupling portion and the second end can include a second container coupling portion. A bulb portion can be positioned between the first end and the second end. A first valve portion positioned between the bulb portion and the first end. Optionally, a second valve portion positioned between the bulb portion and the second end.

12 Claims, 10 Drawing Sheets

BOTTLE CONTENTS MERGING APPARATUS AND METHOD THEREOF

CROSS-REFERENCE TO RELATED APPLICATION

This U.S. patent application patent application claims priority to U.S. Provisional Application 63/516,867 filed Aug. 1, 2023, the disclosure of which is considered part of the disclosure of this application and is hereby incorporated by reference in its entirety.

FIELD OF THE INVENTION

The invention relates generally to an apparatus configured to merge or transfer the contents of a first bottle to a second bottle.

BACKGROUND

Currently there are a number of solutions for merging bottle contents together. One of these solutions attempts to utilize gravity to merge two bottles together by generally tipping a first bottle over and above a second bottle, but this solution fails to meet the needs of the market because the user has to hold the first bottle in place. Another solution attempts to tape the two bottles together, but this solution is similarly unable to meet the needs of the market because the tape leaves a sticky residue on the remaining bottle. Still another solution seeks to lean, rest, or support the top bottle against a surface to generally hold it into position, but this solution also fails to meet market needs because the mouths of the two bottles are not lined up and a mess can occur.

It would be advantageous to have an apparatus that utilizes gravity to merge bottles together. Furthermore, it would also be advantageous to have an apparatus that held and supported the bottles together. Additionally, it would be advantages for an apparatus to quickly move contents from a first container to a second container. Therefore, there currently exists a need in the market for an apparatus that is a hands-free holder for merging the contents of bottles. The apparatus is a holder for merging two bottles.

BRIEF SUMMARY OF THE INVENTION

The invention advantageously fills the aforementioned deficiencies by providing a merging bottle content holder, which provides a hands-free option for merging the contents of bottles.

In one aspect, the present disclosure is related to a fluid merging apparatus that can include a first end and a second end. The first end can include a first container coupling portion and the second end can include a second container coupling portion. A bulb portion can be positioned between the first end and the second end. The bulb portion can be a siphon squeeze bulb with one or more check valves. A first valve portion positioned between the bulb portion and the first end. Optionally, a second valve portion positioned between the bulb portion and the second end. The container coupling portions can be generally round in orientation and the first end can have a first prescribed diameter and the second end can have a second prescribed diameter. The first diameter and second diameter can be the same or different depending upon the application. The container coupling portions can include an exterior sidewall. The second container coupling portion can further include a tube portion extending from the second valve portion past the first end.

The first valve portion can have a first opening and a second opening, and the second valve portion has a first opening and a second opening. In some exemplary embodiments, the valve portions can have a directional flow means includes a check ball valve having a ball portion and a biasing portion. The valve portions can include a valve body with an aperture therethrough, wherein a biasing means and ball can be positioned within the aperture. The first and second valve have a directional flow means configured to allow for the flow of liquid from a first container to a second container in a single direction. The biasing means can be a spring to help maintain the balls in a first position within the valve body. The directional flow means includes a ball portion biased between a first position and a second position, wherein the first position is a closed position, and the second position is an open position. Depressing the bulb position moves the first valve into a closed position and the second valve into an open position. The apparatus can further include one or more adapter portions that can be removably coupled with the one or more of the container coupling portions.

In another aspect, the present disclosure is related to a method of moving liquid from one container to another container by providing a first merging apparatus to support a first container and a second container. The merging apparatus can first be coupled to the first container at the first end and then coupled to the second container at the second end. A bulb portion can be depressed or squeezed to move the contents of a first container into the bulb portion and then into the second container.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1A:
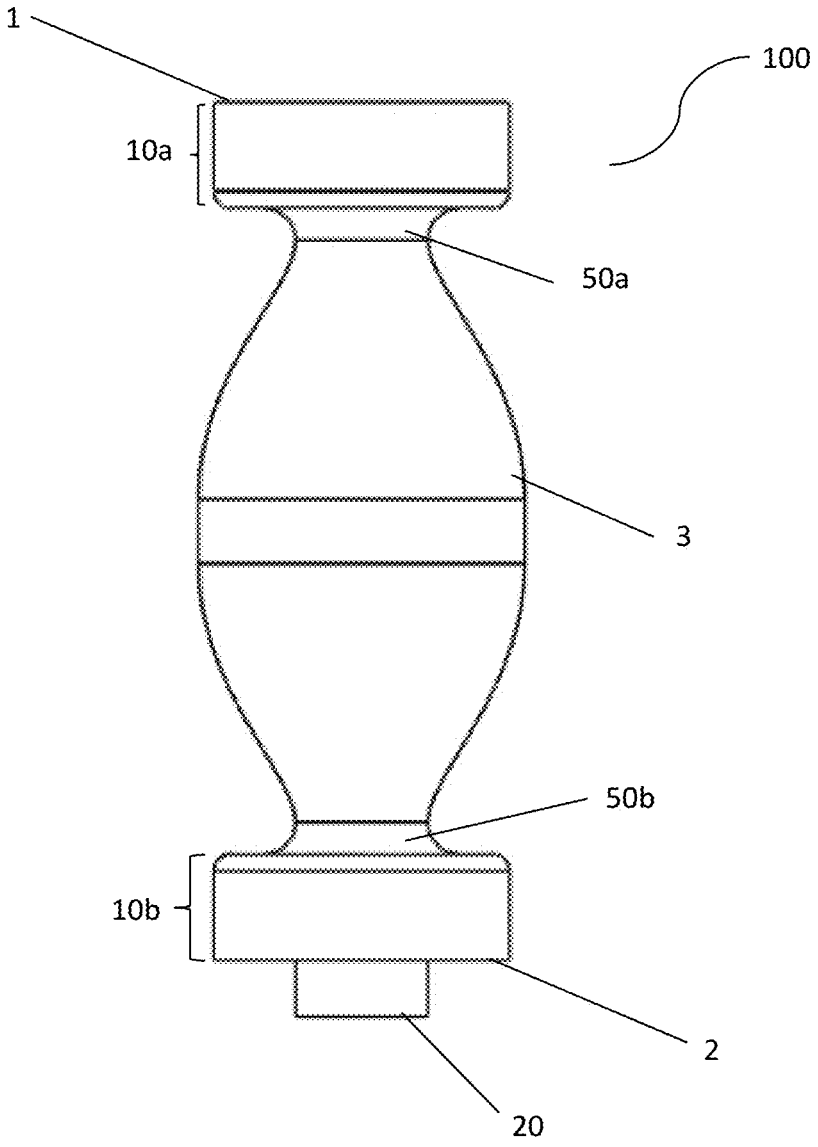
FIG. 1A is a side view illustration of an exemplary embodiment of the apparatus of the present disclosure.
Figure 1B:
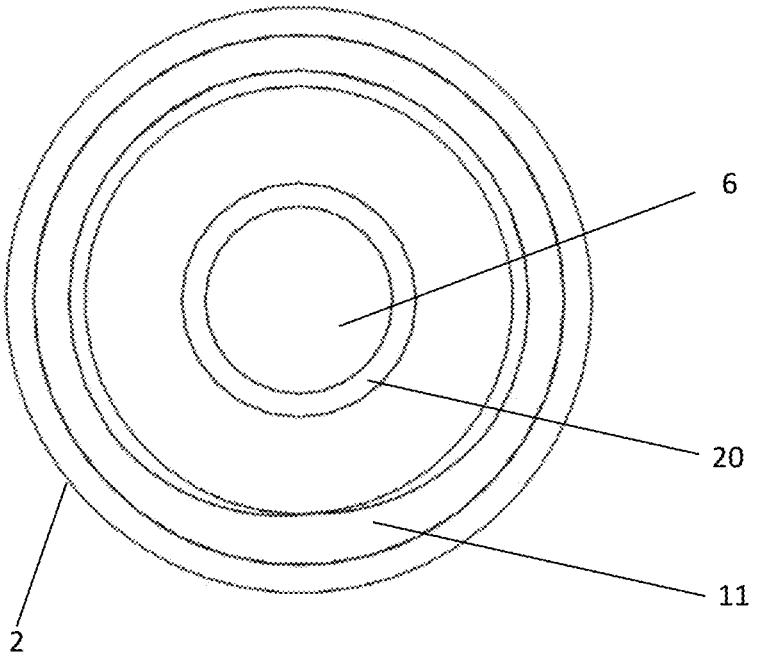
FIG. 1B is a bottom view illustration of an exemplary embodiment of the apparatus of the present disclosure.
Figure 1C:
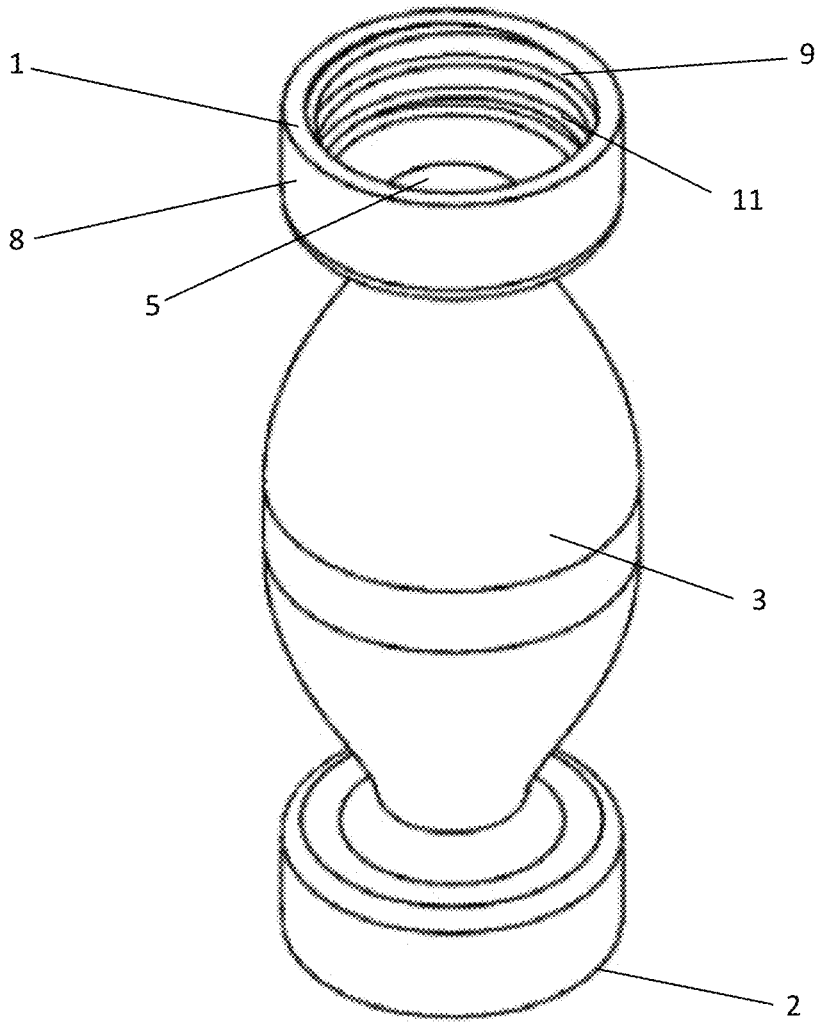
FIG. 1C is a perspective view illustration of an exemplary embodiment of the apparatus of the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS., with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

As illustrated in FIG. 1-6, the present disclosure relates to an apparatus configured to merge liquids from a first container or reservoir to a second container or reservoir. The merging apparatus 100 of the present disclosure can include a first end 1 and a second 2. The first end 1 can be coupled to a first container 200 and the second end 2 can be coupled to a second container 300 to aid in quickly transferring a liquid or residual material from the first container 200 to the second container 300. A bulb portion 3 can be positioned between the first end 1 and the second end 2 of the apparatus 100 as shown in FIGS. 1A-1C. The bulb portion 3 can have a first end and a second end. The bulb portion 3 can have an interior cavity 4 and can be depressed or squeezed by a user. The apparatus 100 can be removably coupled to each container to prevent the need of a user to support or otherwise hold the bottles together for a long duration of time. In some exemplary embodiments, the apparatus 100 can have a first opening 5 between the first end 1 and the bulb portion 3 and a second opening 6 between the bulb portion 3 and the second end to allow a liquid to flow from a first container 200 to the second container 300 utilizing gravity. The opening can allow fluid to pass through the apparatus from one container to a second container.

The first end 1 can be formed in generally a round configuration and can have a first diameter. Similarly, the second end 2 can have a generally round configuration and can have a second diameter. The first diameter and second diameter can be the same or different depending upon the desired user application. The second end 2 can further include a tube portion 20 that can extend generally downward from the second opening 6 to direct the liquid or fluid as it passes through the bulb portion 3 into the second container 300. In some exemplary embodiments, the tube portion 10 can extend past the second end of the apparatus as shown in FIG. 1A.

The first end 1 and second end can each be formed with an exterior sidewall 8 and an interior sidewall 9 to form a container coupling portion 10*a,b*. The interior sidewall 9 can be generally smooth or in some exemplary embodiments can have ridges 11 or threading that can be configured to couple to and interface with the opening 201 of a container 200, including but not limited to a bottle. In some exemplary embodiments, the interior sidewall can have a threading that corresponds to the threading on the end of a container. Alternatively, the ridges 11 can be formed to allow for the end of a container to pass through one or more layers of ridges 11 and form a sealable coupled relationship between the first or second end 1, 2 and the respective first or second container 200, 300. The ridges 11 can provide a universal coupling adapter for multiple container opening sizes and maintain a sealable connection with the opening of the container.

Figure 2A:
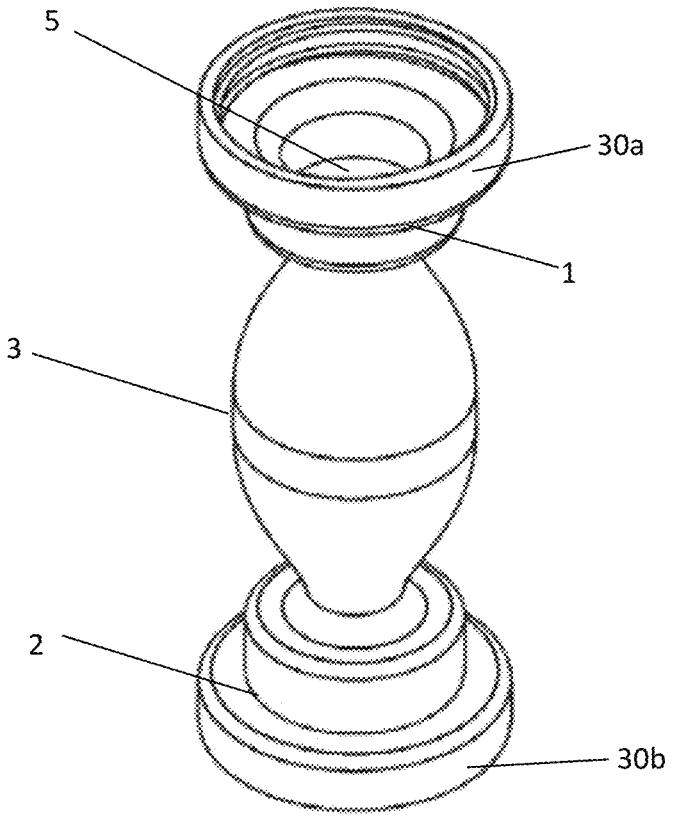
FIG. 2A is a perspective view illustration of an exemplary embodiment of the apparatus of the present disclosure.
Figure 2B:
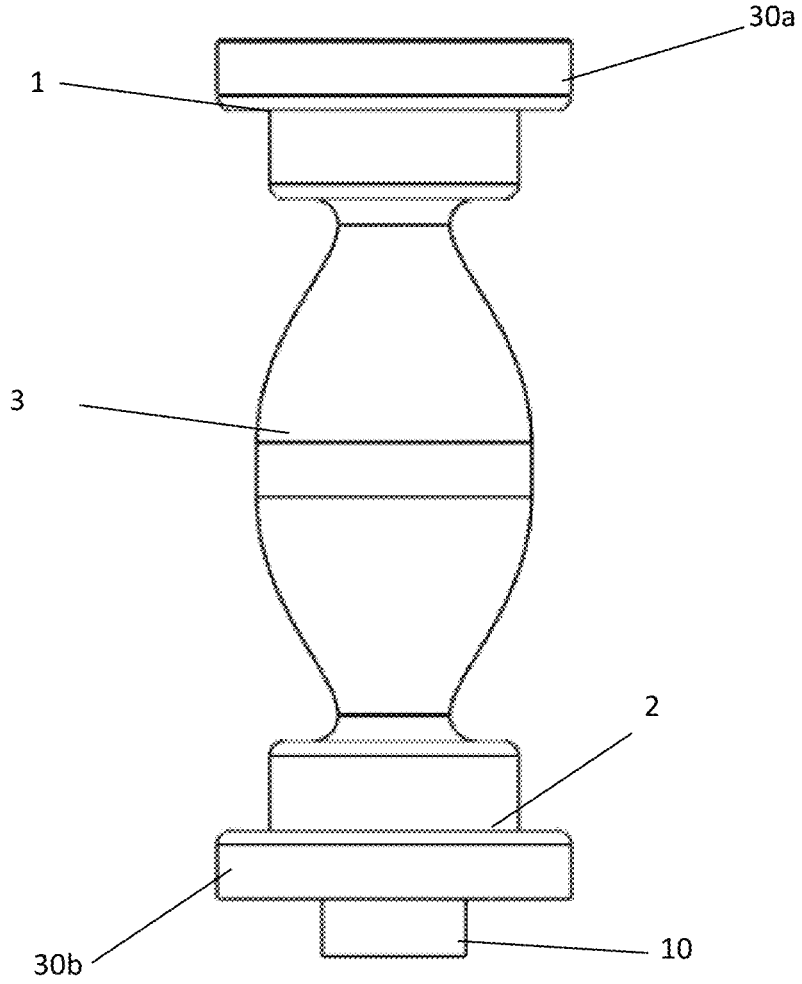
FIG. 2B is a side view illustration of an exemplary embodiment of the apparatus of the present disclosure.

Optionally, one or more adapter portions 30*a,b* can be coupled to or formed on the first end 1 and/or second end as shown in FIGS. 2A-2*b*. The adapter portions 30*a,b* can be coupled to one or more of the container coupling portions 10*a,b* to allow a user to easily adapt the apparatus for a plurality of container opening types. In one exemplary embodiment, both container coupling portions 10*a,b* can have the same diameter with a threading. One or more different adapter portions 30*a,b* can include corresponding threading on the exterior sidewall as the threading on a coupling portion to couple the adapter portion 30 to the container coupling portion 10. This can allow a user to utilize the apparatus in situations where the first container has a different opening size than the second container, or alternatively for the apparatus to be used with a wide array of container opening sizes by providing various adapter portions 30 and coupling them to the container coupling portions 10 as needed.

Figure 3:
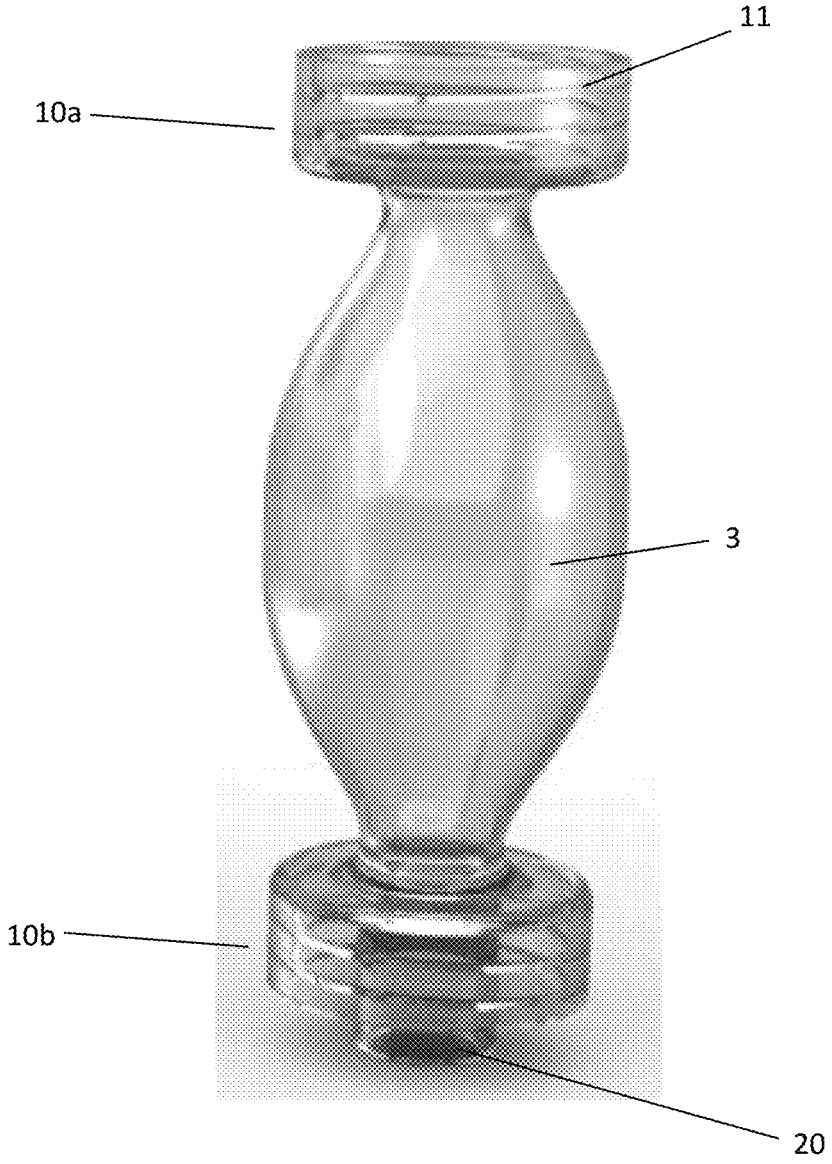
FIG. 3 is a transparent view illustration of an exemplary embodiment of the apparatus of the present disclosure.

FIG. 3 provides an exemplary embodiment of an apparatus of the present disclosure comprised of a clear material, including but not limited to a plastic, polymer, rubber, silicone, or other type of material. In some exemplary embodiments, the bulb portion 3 is comprised of a material that has elasticity to allow a user to depress or squeeze the bulb portion 3. In some exemplary embodiments, the material can be clear or transparent to allow a user to view the progress of the transfer of the liquids from one container to another container. Alternatively, the material can be solid and not visible to a user. The material can similarly be comprised of a recyclable material or polymer.

Figure 4:
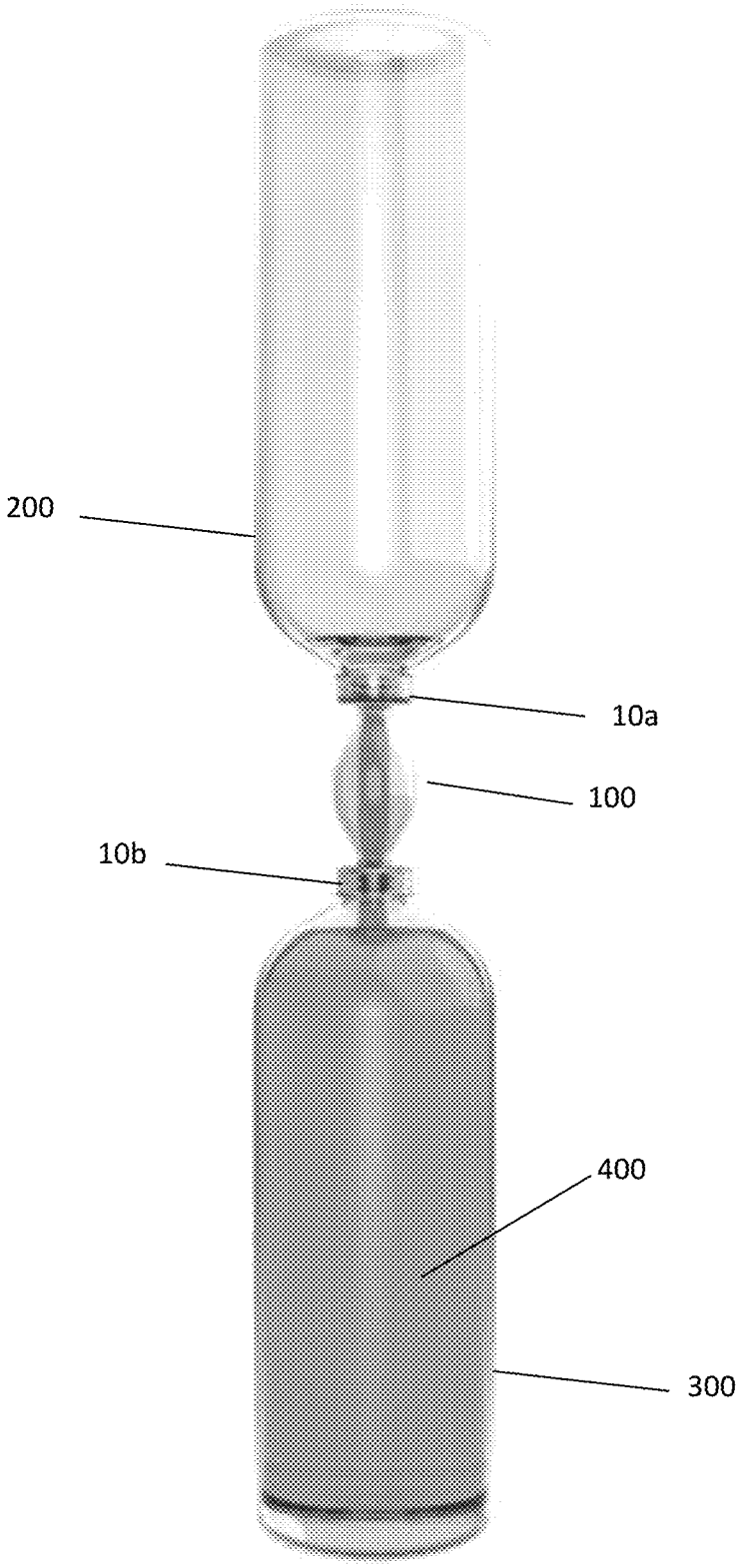
FIG. 4 is an illustration of an exemplary embodiment of an apparatus of the present disclosure coupled between a first container and a second container.
Figure 5:
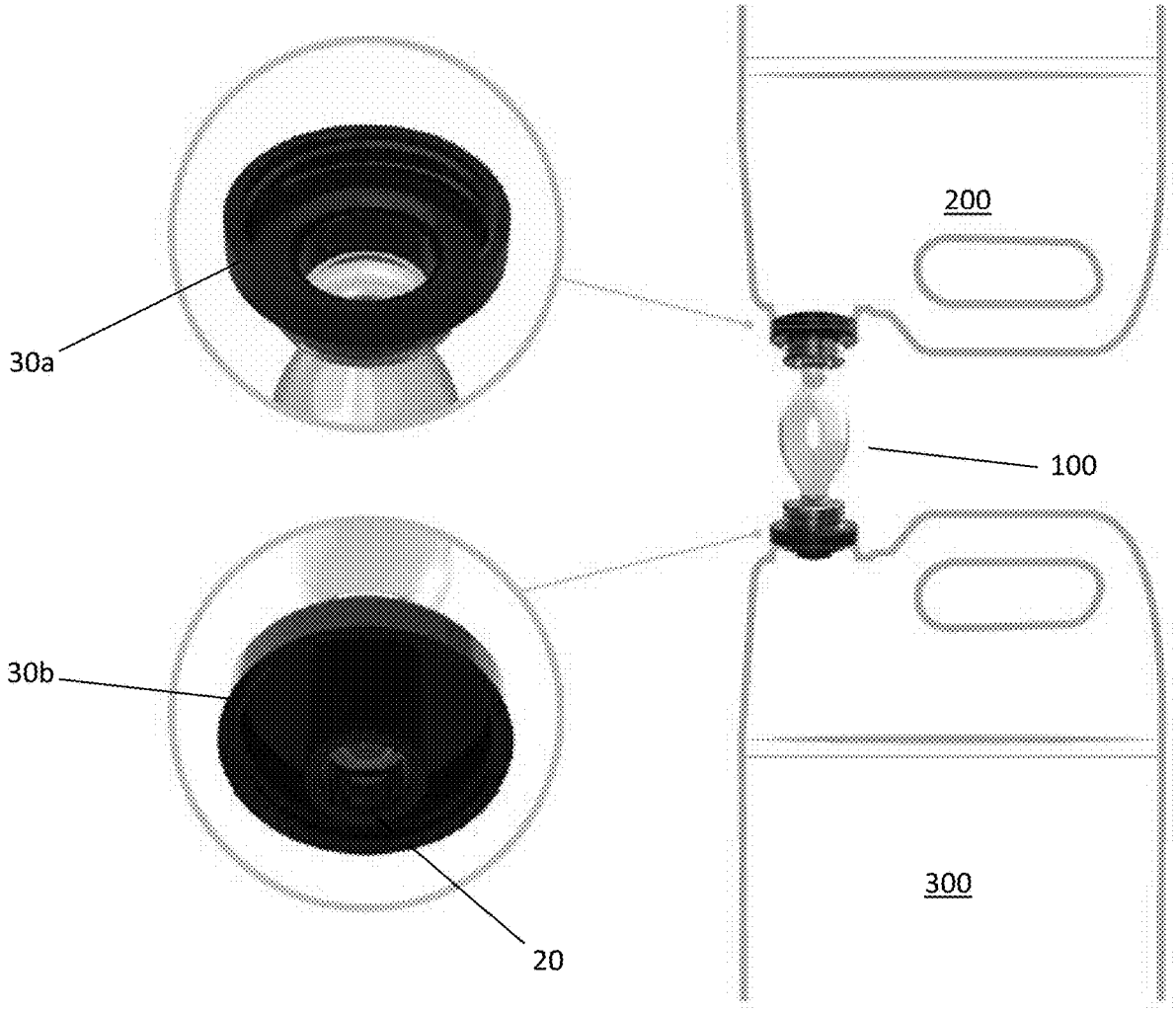
FIG. 5 is an illustration of an exemplary embodiment of an apparatus of the present disclosure coupled between a first container and a second container.

As shown in FIG. 4, the apparatus 100 can be removably coupled to a first container 200 at the first end 1 and a second container 300 at the second end 2 utilizing the respective container coupling portions 10*a,b*. A liquid or fluid 400 can pass from the first container 200 to the second container 300 over a period of time. FIG. 5 provides a similar illustration of the apparatus 100 utilizing adapter portions 30*a,b* coupled to the respective container coupling portions 10 for containers with a larger opening.

Figure 6A:
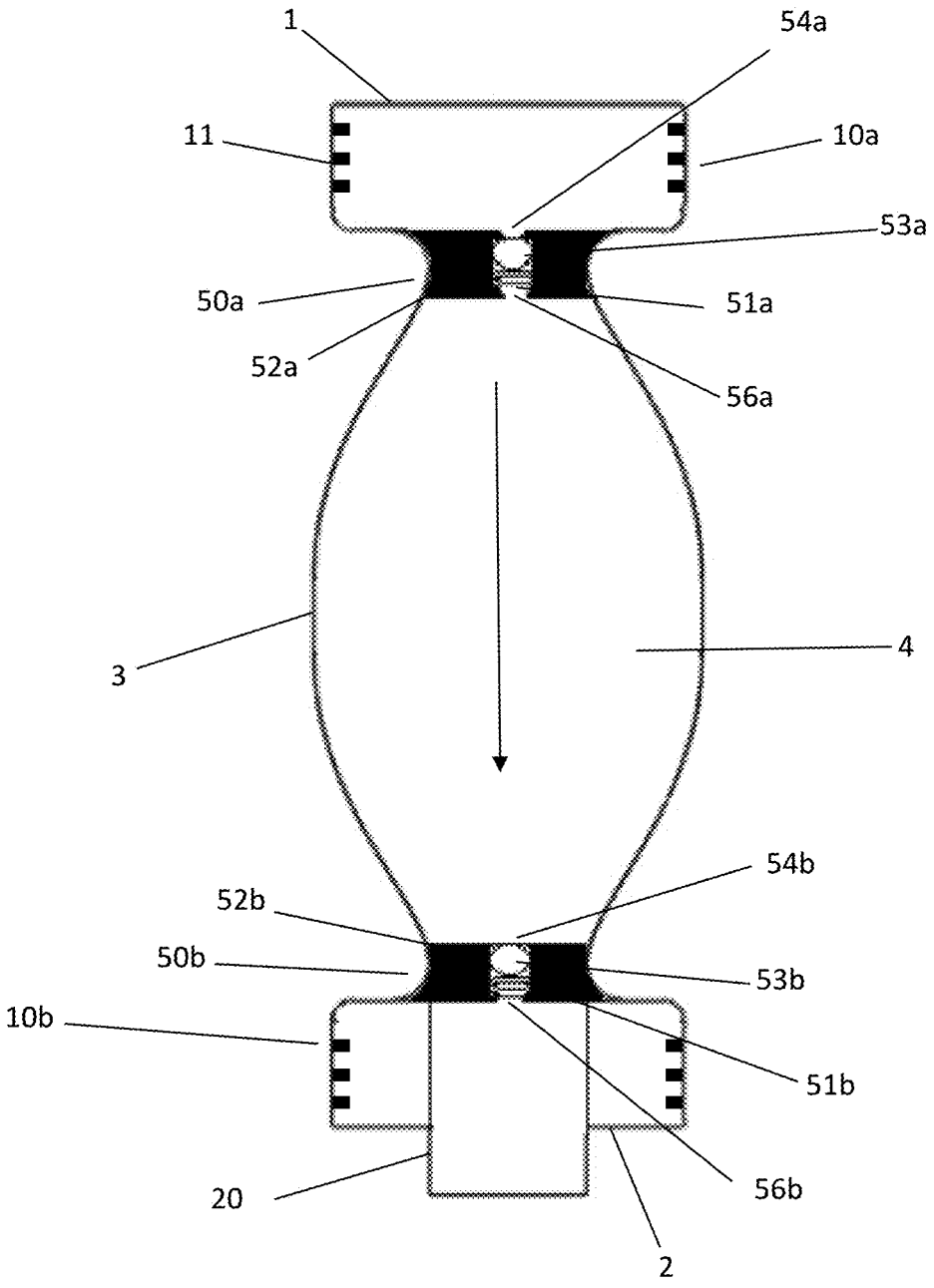
FIG. 6A is a cross-section view of an exemplary embodiment of the apparatus of the present disclosure having two check valves.

In another exemplary embodiment, the apparatus 100 can include a one of more valve portions 50 that can be positioned in the first opening, second opening, or both openings as shown in FIG. 6A. The valve portions 50*a,b* can be unidirectional valves that can be configured to only allow for the flow of liquid to move in one direction from the first end 1 to the second end 2 of the apparatus and into the second container. The valve portions 50 can allow for the fluid to pass more rapidly from the first container 200 to the second container 300 be depressing or squeezing the bulb portion 3 of the apparatus which can cause the first valve portion 50*a* to close upon depressing while opening the second valve portion 50*b*. This method allows fluid within the cavity 4 of bulb portion 3 to be transferred rapidly into the second container 300 without allowing the fluid to move back into the first container 200. As the bulb returns back to its original orientation a vacuum can be formed or the first valve portion can be configured to open back up to allow additional fluid from the first container 200 to move or progress into the bulb portion 3. This process can be repeated as needed in order to transfer all the fluid from the first container 200 to the second container.

In some exemplary embodiments, the valve portions 50 can be any suitable type of unidirectional flow valves. In one exemplary embodiment, the valve portions 50 can be ball check valves. The valves portions 50 can include a biasing means 51, including but not limited to a spring, and a ball or plug 53. The biasing means 51 can aid in maintaining the ball 53 in a first position within the valve body 52. The valve bodies can have a first opening 54 and a second opening 56 forming an aperture between the first opening and second opening. The aperture can provide a path for a fluid to flow through the valve portion when the valve is opened. The ball portions 53 can be seated and sealed against a wall to prevent liquid from flowing through the aperture.

Figure 6B:
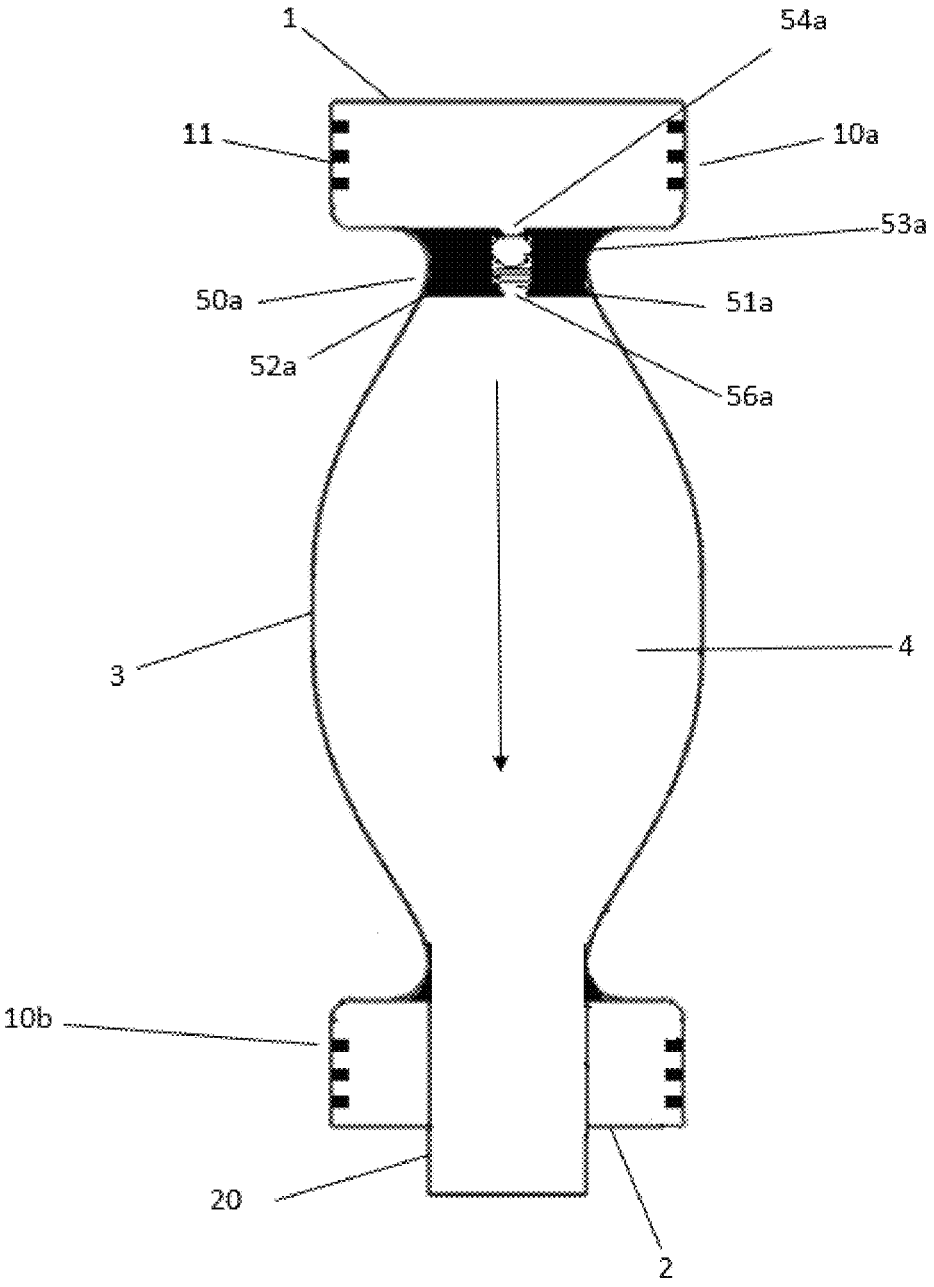
FIG. 6B is a cross-section view of an exemplary embodiment of the apparatus of the present disclosure having one check valve.

The first opening 54*a* of the first valve body 52*a* can be fluidly connected to the first container at the ball 53 can be positioned in a first position to allow fluid from the first container 200 to the bulb portion 3 and the second valve body 52*b* can be in a first position when the ball 53*b* is seated against the first opening 54*b*. When the bulb portion is depressed, the respective balls 53*a,b* can be moved to a respective second position wherein the second valve ball 53*b*, is depressed from being seated against the opening 54*b* to allow fluid within the bulb portion cavity 4 to move out and into the second container 300. Similarly, the first valve ball 53*a* is forced to be seated against the opening 54*a* to prevent any liquid or fluid from being forced back into the first container 200. The biasing means 51 can aid in assisting with the movement of the balls within the valve bodies or alternatively external pressure such as a vacuum created after the bulb portion is depressed and returning back to its initial form can aid in the movement of the balls 53*a,b* from their respective first positions to second positions within the valve body 52. In other exemplary embodiments, the apparatus 100 may only include a single check valve 50 at the first end as shown in FIG. 6B to prevent backflow into the first container 200.

Various related embodiments of the invention are also described in Appendix A and the provisional application referenced above, which are incorporated herein by reference in its entirety.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A fluid merging apparatus comprising:

a first end and a second end, wherein the first end comprises a first container coupling portion having an exterior sidewall and an interior sidewall and the second end comprises a second container coupling portion having an exterior sidewall and an interior sidewall, wherein first end is round and has a first prescribed diameter, and the second end is round and has a second prescribed diameter;

a bulb portion positioned between the first end and the second end;

a first valve portion positioned between the bulb portion and the first end; and a second valve portion positioned between the bulb portion and the second end.

2. The apparatus of claim 1, wherein the second end further comprises a tube portion extending from the second valve portion past the first end.

3. The apparatus of claim 2, wherein the first valve portion has a first opening and a second opening, and the second valve portion has a first opening and a second opening.

4. The apparatus of claim 3, wherein the first and second valve have a directional flow means configured to allow for the flow of liquid from a first container to a second container in a single direction.

5. The apparatus of claim 4, wherein the directional flow means includes a check ball valve having a ball portion and a biasing portion.

6. The apparatus of claim 5, wherein the biasing portion is a spring.

7. The apparatus of claim 6, wherein the directional flow means includes a ball portion biased between a first position and a second position, wherein the first position is a closed position, and the second position is an open position.

8. The apparatus of claim 7, wherein depressing the bulb position moves the first valve into a closed position and the second valve into an open position.

9. The apparatus of claim 8, wherein one or more adapter portions can be removably coupled with the one or more of the first end or second end.

10. A fluid merging apparatus, comprising:

a first end and a second end, wherein the first end comprises a first container coupling portion and the second end comprises a second container coupling portion, wherein the first container coupling portion is removably couplable to a first container and the second container coupling portion is removably couplable to a second container, wherein the first container coupling portion and the second container coupling portion have a plurality of ridges on an interior sidewall configured to form a sealing relationship with the exterior sidewall of a container opening;

a bulb portion positioned between the first end and the second end, wherein the bulb portion is comprised of an elastic material and configured to be moved from an open position to a depressed position; and a first valve portion positioned between the bulb portion and the first end, wherein the first valve portion is a unidirectional valve configured to allow a fluid within the first container to flow in a single direction to the bulb portion, wherein when the bulb portion is positioned in the depressed position the fluid in the bulb portion is pushed into the second container and seals the first valve portion to prevent the fluid from flowing back into the first container, wherein the bulb portion generates a vacuum to pull the fluid from the first container into the bulb portion.

11. The apparatus of claim 10, wherein the first valve portion is a check ball valve having a ball portion and a biasing means to move the ball between a first position and second position.

12. The apparatus of claim 11, further comprising a second valve portion positioned between a second end of the bulb portion and the second container coupling portion.

* * * * *